US007543727B2

(12) United States Patent
Strååt et al.

(10) Patent No.: US 7,543,727 B2
(45) Date of Patent: Jun. 9, 2009

(54) CIRCUIT BREAKER ARRANGEMENT IN AN INDICATING ARRANGEMENT IN AN ELECTRICALLY POWERED STAPLER

(75) Inventors: Olle Strååt, Hestra (SE); Peter Johansson, Hestra (SE); Mattias Palmquist, Hestra (SE); Ulf Jönsson, Hyltebruk (SE)

(73) Assignee: Isaberg Rapid AB, Hestra (SE)

( * ) Notice: Subject to any disclaimer, the term of this patent is extended or adjusted under 35 U.S.C. 154(b) by 0 days.

(21) Appl. No.: 11/663,956

(22) PCT Filed: Aug. 19, 2005

(86) PCT No.: PCT/SE2005/001221

§ 371 (c)(1),
(2), (4) Date: Jan. 14, 2008

(87) PCT Pub. No.: WO2006/036098

PCT Pub. Date: Apr. 6, 2006

(65) Prior Publication Data

US 2008/0156845 A1 Jul. 3, 2008

(30) Foreign Application Priority Data

Sep. 28, 2004 (SE) ..... 0402331

(51) Int. Cl.
*B27F 7/17* (2006.01)

(52) U.S. Cl. ..... 227/2; 227/120; 227/131; 361/156

(58) Field of Classification Search ..... 227/2, 227/8, 7, 120, 109, 131, 138; 361/155, 156, 361/194, 205; 327/463, 464
See application file for complete search history.

(56) References Cited

U.S. PATENT DOCUMENTS

| | | | | |
|---|---|---|---|---|
| 3,971,969 | A | 7/1976 | Wines et al. | 317/148.5 B |
| 4,558,391 | A * | 12/1985 | Ward et al. | 361/155 |
| 4,573,625 | A | 3/1986 | Olesen et al. | 227/131 |
| 5,007,572 | A * | 4/1991 | Chung-Cheng | 227/7 |
| 5,105,329 | A * | 4/1992 | Goldner | 361/156 |
| 5,427,296 | A | 6/1995 | Chen | 227/7 |

(Continued)

FOREIGN PATENT DOCUMENTS

GB 2 212 433 7/1989

*Primary Examiner*—Scott A. Smith
(74) *Attorney, Agent, or Firm*—Miles & Stockbridge P.C.

(57) ABSTRACT

Circuit-breaker arrangement (32) in an indicating arrangement (33) forming part of an electrically powered stapler (1). The stapler comprises a stapling head (2) and an anvil (3). The stapling head comprises an interchangeably fitted staple cassette (5) containing staple blanks (36), and the indicating arrangement. The circuit-breaker arrangement is so positioned that it is moved by the staple cassette from a first to a second position when the staple cassette is fitted to the stapling head and when the power supply via the indicating arrangement changes. The circuit-breaker arrangement (32) comprises an input line (22) and output line (23), of which at least the input line is dimensionally stable and resiliency flexible. The input line is impinged upon by an electrically non-conductive region (34) of the staple cassette when the latter is fitted to the stapling head, with the result that the line is moved against its resilient resistance so that the circuit-breaker arrangement switches from the first position to the second position. The resilient resistance returns the circuit-breaker arrangement to the first position when the cassette is removed from the stapling head.

6 Claims, 10 Drawing Sheets

U.S. PATENT DOCUMENTS 5,657,918 A * 8/1997 Shimomura et al. ..... 227/7
5,772,197 A * 6/1998 Aoki et al. ..... 270/58.08
6,543,667 B2 * 4/2003 Yoshie et al. ..... 227/120
6,769,592 B2 * 8/2004 Strålåt ..... 227/131
6,811,070 B2 * 11/2004 Takada ..... 227/120
7,097,087 B2 * 8/2006 Lammers et al. ..... 227/131

* cited by examiner

CIRCUIT BREAKER ARRANGEMENT IN AN INDICATING ARRANGEMENT IN AN ELECTRICALLY POWERED STAPLER

TECHNICAL FIELD

The present invention relates to a circuit-breaker arrangement in an indicating arrangement forming part of an electrically powered stapler, trough which arrangement a current is supplied which is registered by a control means which is electrically connected to the arrangement and by which the stapler is controlled, which stapler comprises a stapling head and an anvil, said stapling head comprising a staple cassette fitted interchangeably in the stapling head and accommodating staple blanks, and the indicating arrangement, which arrangement comprises an electrical line itself comprising the circuit-breaker arrangement which is connected to said line by an input line and an output line and which is in a first position when no staple cassette is fitted in the stapling head and in a second position when a staple cassette is fitted in the stapling head, the lines being connected together for electrical conduction in one of the positions and being separated as regards electrical conduction in the other position, and the circuit-breaker arrangement being so positioned as to be moved by the staple cassette from the first to the second position when the staple cassette is fitted to the stapling head, resulting in the power supply via the indicating arrangement being changed, which change is registered by the control means.

STATE OF THE ART

Circuit-breaker arrangements in indicating arrangements of the kind indicated above are previously known. The circuit-breaker arrangement usually take the form of so-called microswitches which are connected to the electrical line and are so positioned in the stapling head that they are acted upon by the cassette when the latter is fitted to the stapling head. The disadvantage, however, of using these microswitches is that not only are they relatively expensive but it may also happen that their connection to the electrical conductor becomes such that no current can pass through the connection, which may happen when a so-called cold solder occurs or the connection is broken as a result of the stresses to which it is subjected when the circuit-breaker is fitted to the stapling head, which stresses may be considerable, since fitting the circuit-breaker to the stapling head is often a cramped and troublesome operation.

Moreover, the indicating arrangement most commonly comprises more than one circuit-breaker, since it is usually necessary to register both that the cassette is fitted to the stapling head and that there are staple blanks in the cassette, which means that the disadvantages referred to apply to a greater extent and therefore become significantly more difficult to overcome as regards both costs and manufacturing and fitting difficulties.

PROBLEM

There is therefore a need to provide a circuit-breaker arrangement in an indicating arrangement which is inexpensive and easy to fit and does not risk becoming cold-soldered to the electrical line nor suffer such damage due to fitting difficulties that flow of current is prevented when the circuit-breaker arrangement is in the position in which it is intended that current should be supplied by the arrangement.

SOLUTION

The present invention overcomes the stated disadvantages with a circuit-breaker arrangement of the kind indicated in the introduction which is characterised in that the circuit-breaker arrangement comprises an input line and an output line, of which at least the input line is dimensionally stable and resiliently flexible, in that the dimensionally stable and resilient line is impinged upon by a region of the staple cassette when the latter is fitted to the stapling head, resulting in the line being moved against its resilient resistance in such a way that the circuit-breaker arrangement switches from the first position to the second position, and in that the resilient resistance returns the circuit-breaker arrangement to the first position when the cassette is removed from the stapling head.

The present invention is further characterised in that both the input line and the output line are dimensionally stable and resiliently flexible.

The present invention is still further characterised in that the staple cassette moves both the input line and the output line to the second position against their resilient resistance when the cassette is fitted to the stapling head, and that both lines return to the first position when the cassette is removed from the stapling head.

The present invention is further characterised in that a link is provided between the staple cassette and the flexible resilient line and is impinged upon by the staple cassette when the latter is fitted to the stapling head and moves the resilient line to the second position.

BRIEF DESCRIPTION OF THE DRAWINGS

The invention is described below with reference to a preferred embodiment depicted in the attached drawings, in which.

PREFERRED EMBODIMENT

Figure 1:
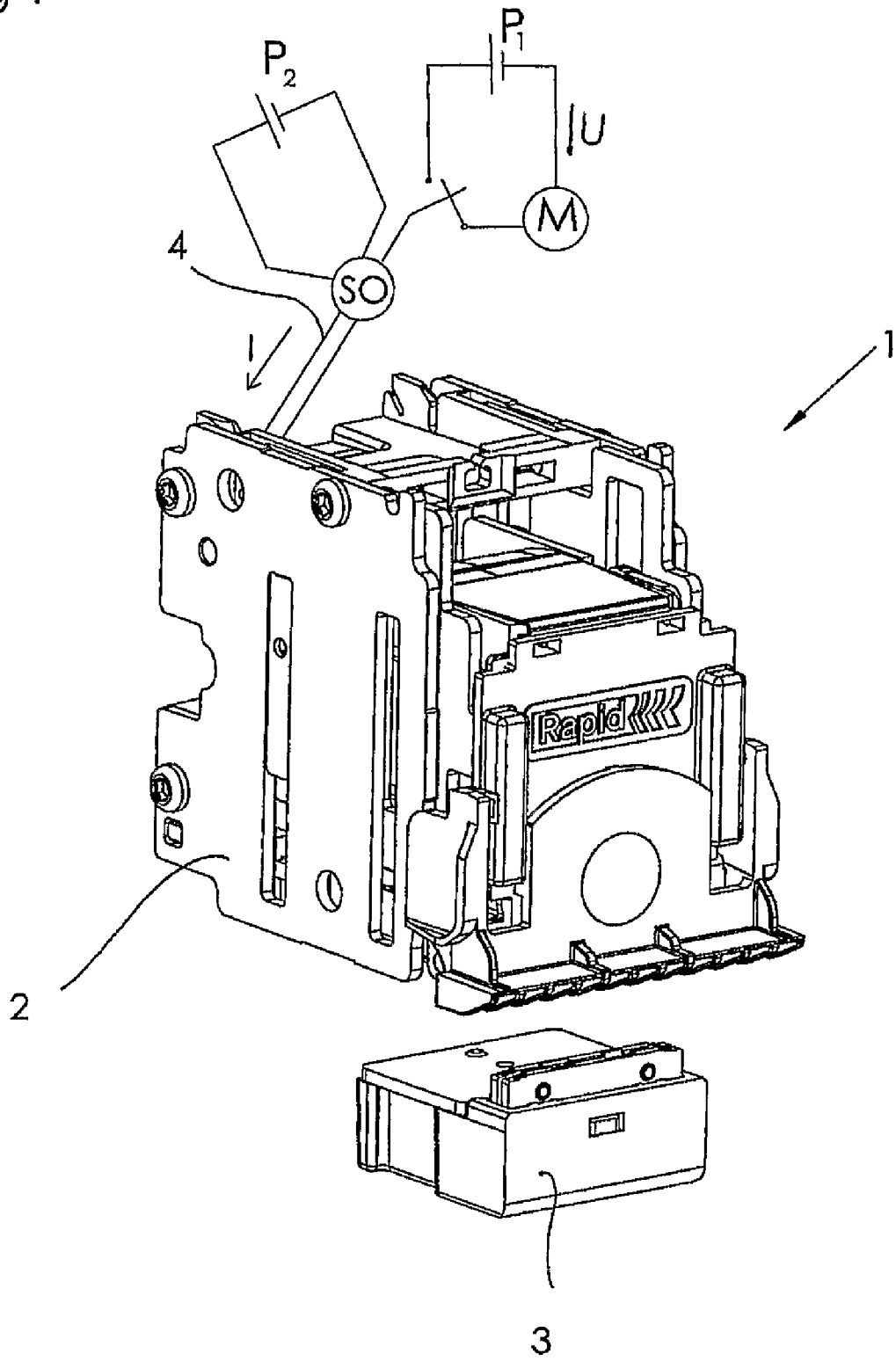
FIG. 1 is a general view of a stapler equipped with a circuit-breaker arrangement according to the present invention.

FIG. 1 depicts a stapler 1 which comprises a stapling head 2 and an anvil 3 against which stapling is effected. The anvil and the stapling head are depicted without any connection, but it will be obvious to one skilled in the art that they are in connection either via a connection means which extends between the anvil and the stapling head and forms part of the stapler, or by their each being fitted to equipment which the stapler forms part of. The drawing also depicts very schematically an electric motor M which drives the stapler and is supplied with a current U from a power source P1, which supply is controlled by a control means SO which is itself supplied with current I from a power source P2 to which is connected an electrical cable 4 which is so arranged that it extends into the stapling head in a manner and with a function which are described in detail below.

Figure 2:
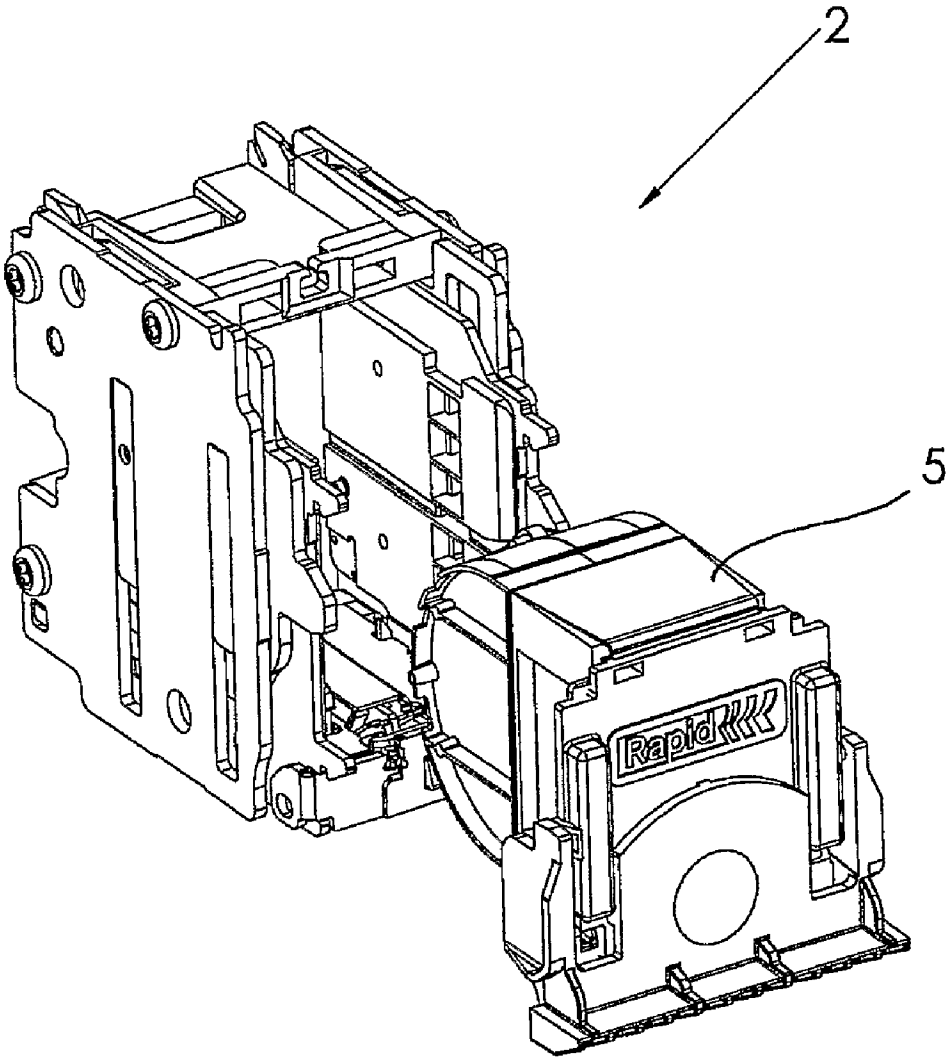
FIG. 2 is a view depicting the stapler's incorporated stapling head with the staple cassette disconnected.
Figure 3:
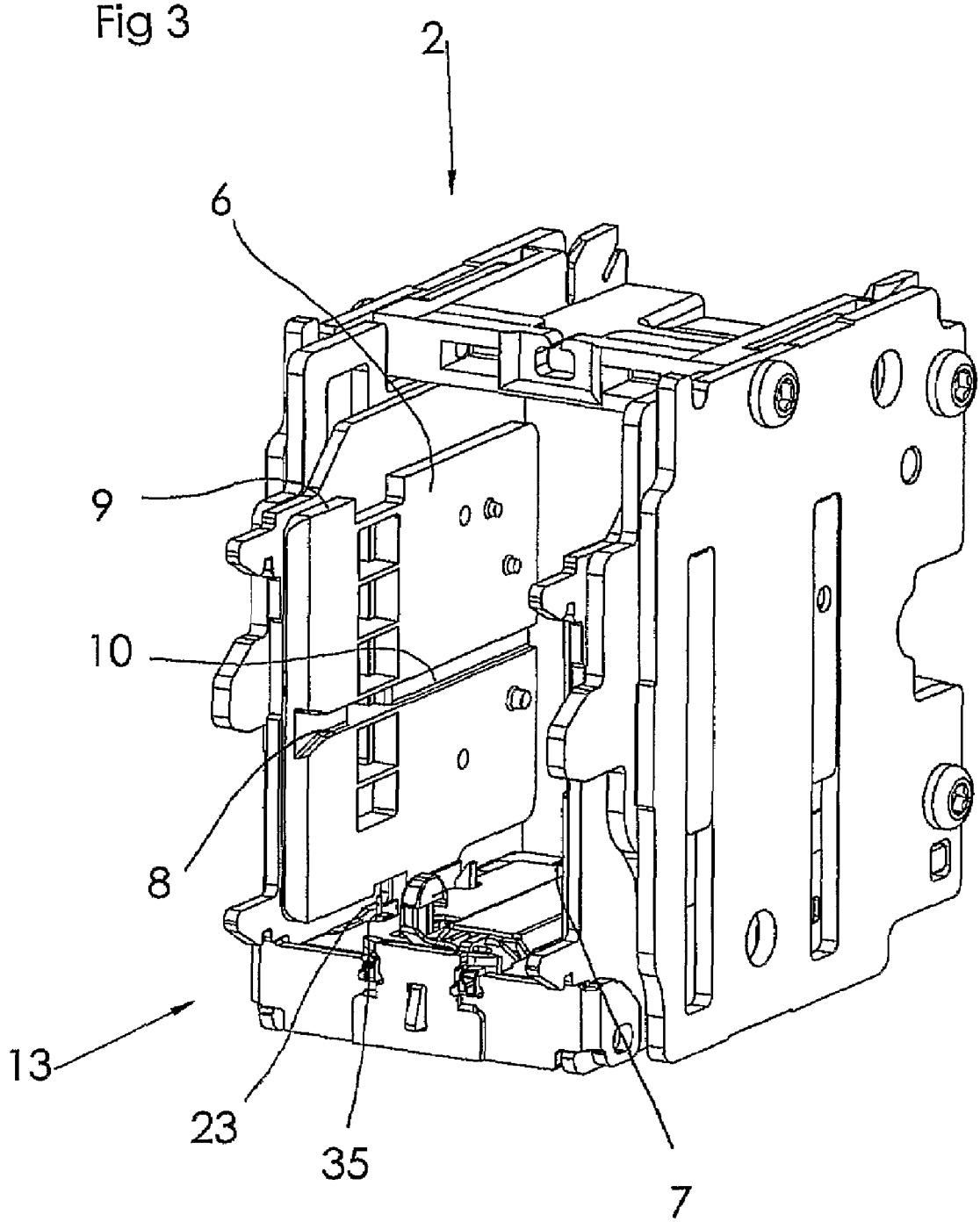
FIG. 3 depicts the stapling head without any staple cassette.
Figure 4:
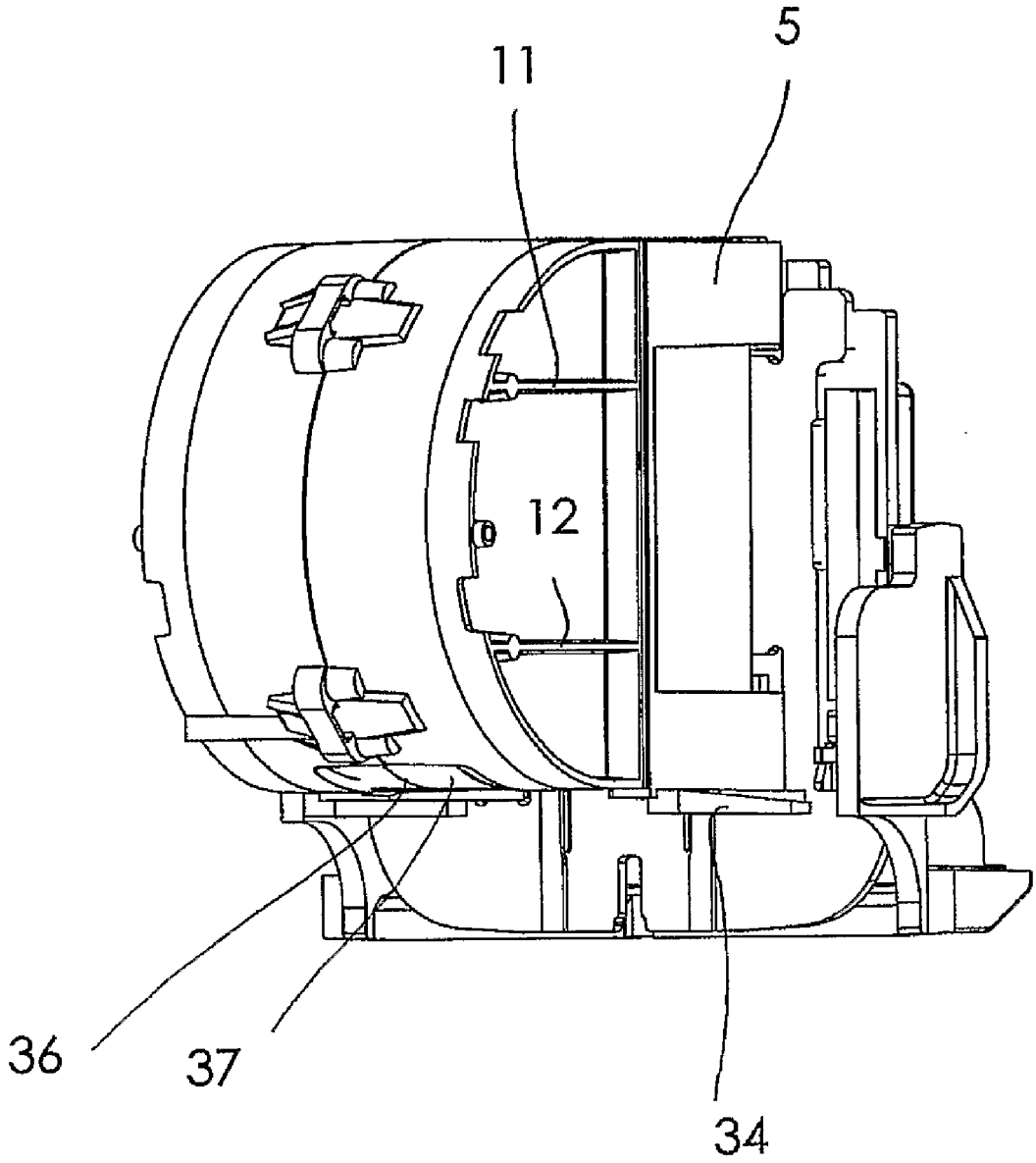
FIG. 4 depicts the staple cassette as seen from the side which is fitted to the stapling head.

FIG. 2 depicts the stapling head 2 and shows the stapling head comprising a staple cassette 5 which is shown disconnected from the stapling head. FIG. 3 depicts the stapling head 2 with the staple cassette disconnected, and FIG. 4 depicts the staple cassette 5 as seen from the side which is fitted to the stapling head. FIG. 3 shows slide surfaces 8, 9 which are provided in the stapling head's walls 6, 7, the slide surface 8 being disposed in a groove 10. The drawing shows only the slide surfaces which are provided in the wall 6, but similar such surfaces are also provided in the wall 7. As may be seen in FIG. 4, slide rails 11, 12 are provided on the staple cassette, only one of them being situated on the side facing towards the observer, but there are also similar rails on the cassette's opposite side which is not visible in FIG. 4.

Figure 5:
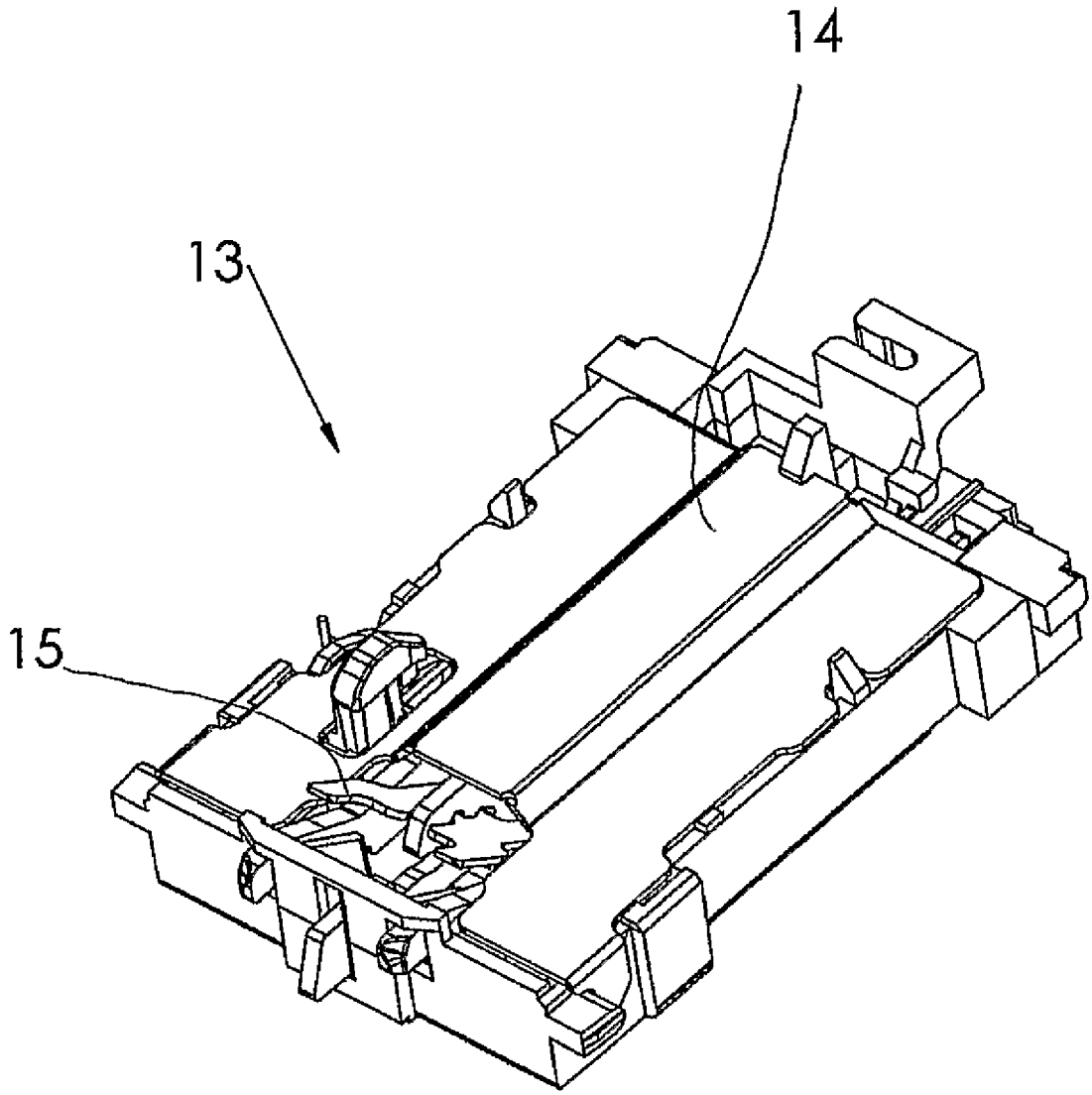
FIG. 5 is a view depicting a lower portion of the stapling head.
Figure 6:
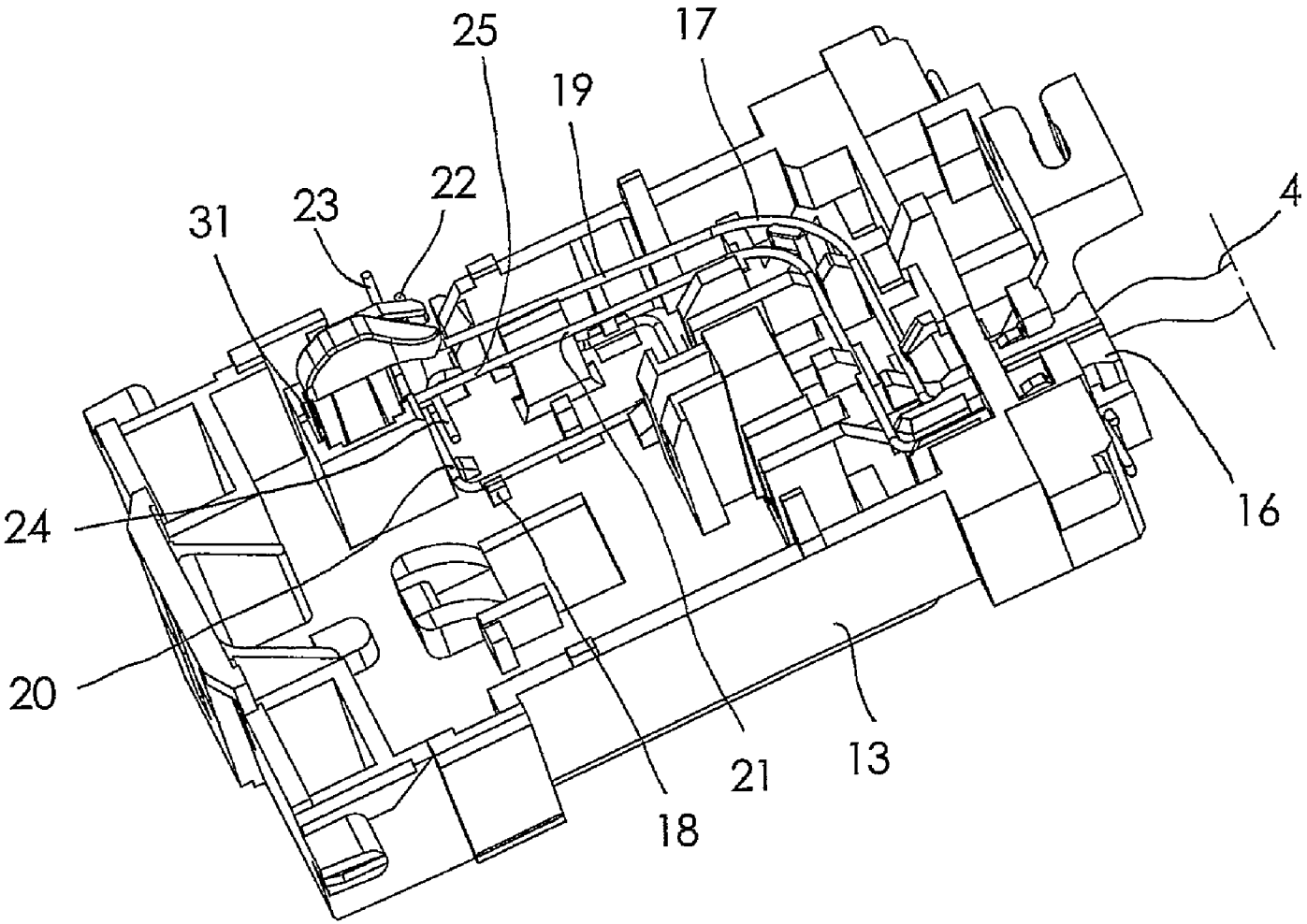
FIG. 6 is a view corresponding to FIG. 5 in which masking portions are omitted in order to depict the invention clearly.
Figure 7:
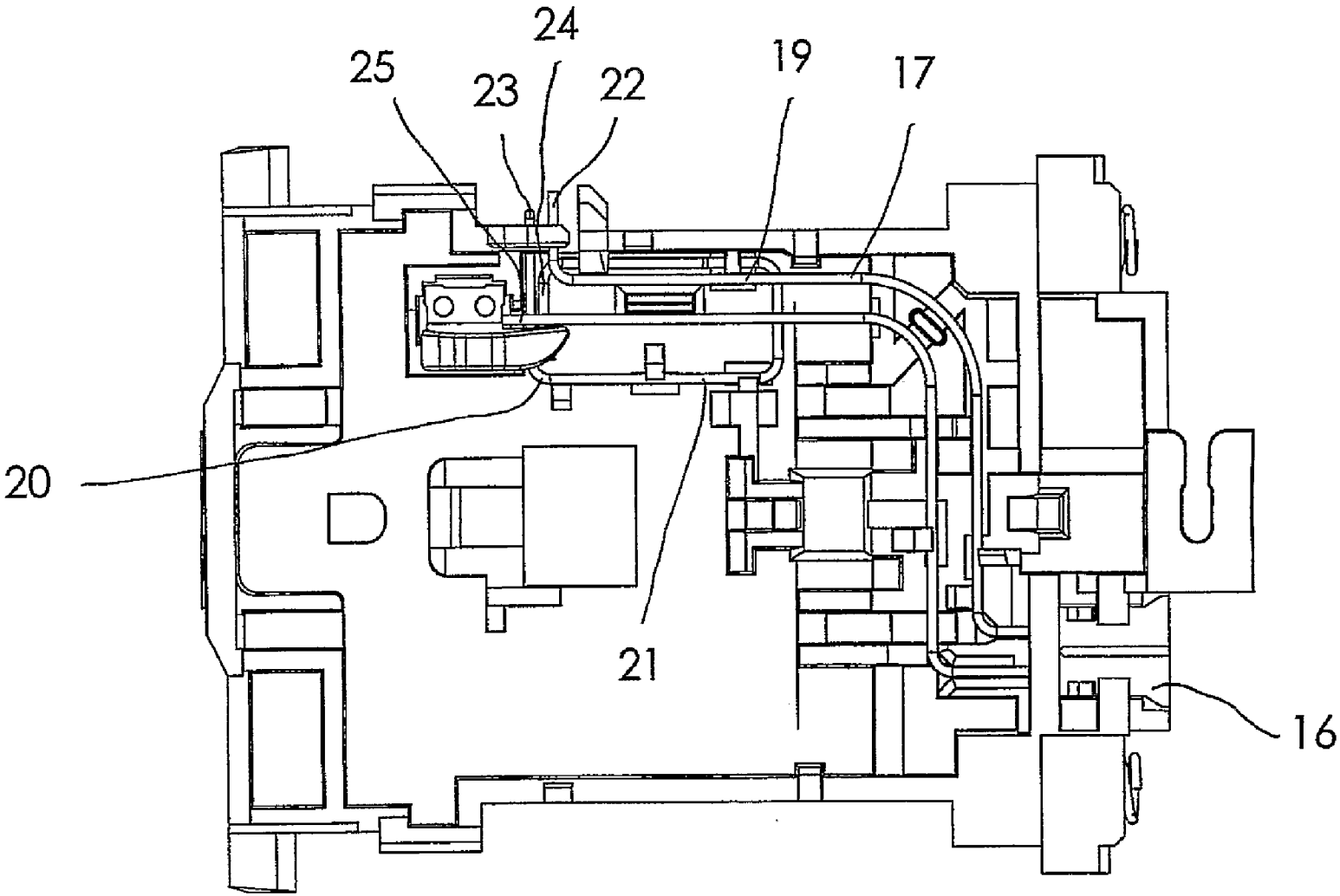
FIG. 7 is a view corresponding to FIG. 6 as seen from above.

FIG. 3 also shows the stapling head comprising a lower portion 13 fitted firmly in the stapling head. FIG. 5 is a detail view of the lower portion 13 and shows the latter having a cover 14 through which a feed tab 15 protrudes upwards and is in contact with a feed arrangement which is accommodated in the lower portion and which is not visible in the drawing and does not form part of the present invention, so no further description of it is given here. FIGS. 6 and 7 show the lower portion 13 with the cover 14 and the feed arrangement omitted thereby revealing a connector 16 to which the cable 4 is connected, which cable is depicted very schematically in FIG. 6. A line 17 made of a dimensionally stable resilient flexible electrically conductive material is connected to the connector 16 in the lower portion 13. The line is connected to, and held in position in, the lower portion 13 by a number of snap fittings 18, and the line divides along its length into a first line portion 19, a second line portion 20 and a third line portion 21. The first line portion is connected at a first end to the connector 16 and becomes at a second end input line 22, the second line portion begins as output line 23 and ends as input line 24, and the third line portion begins as output line 25 and ends by being connected to the connector 16. The drawings depict the line portions in the first position in which no cassette is connected to the stapling head, and they show the input line 22 being kept at a distance from the output line 23, and the input line 24 at a distance from the output line 25. In this first position, as one skilled in the art will readily appreciate, there is no electrically conductive connection between the input lines and the output lines. The fact that the line portions are made of an electrically conductive dimensionally stable resilient flexible material, which may be any material known to one skilled in the art, preferably using a copper material, provides assurance that the snap fittings 18, in the initial position, can hold the line portions in such positions as described above.

Figure 8:
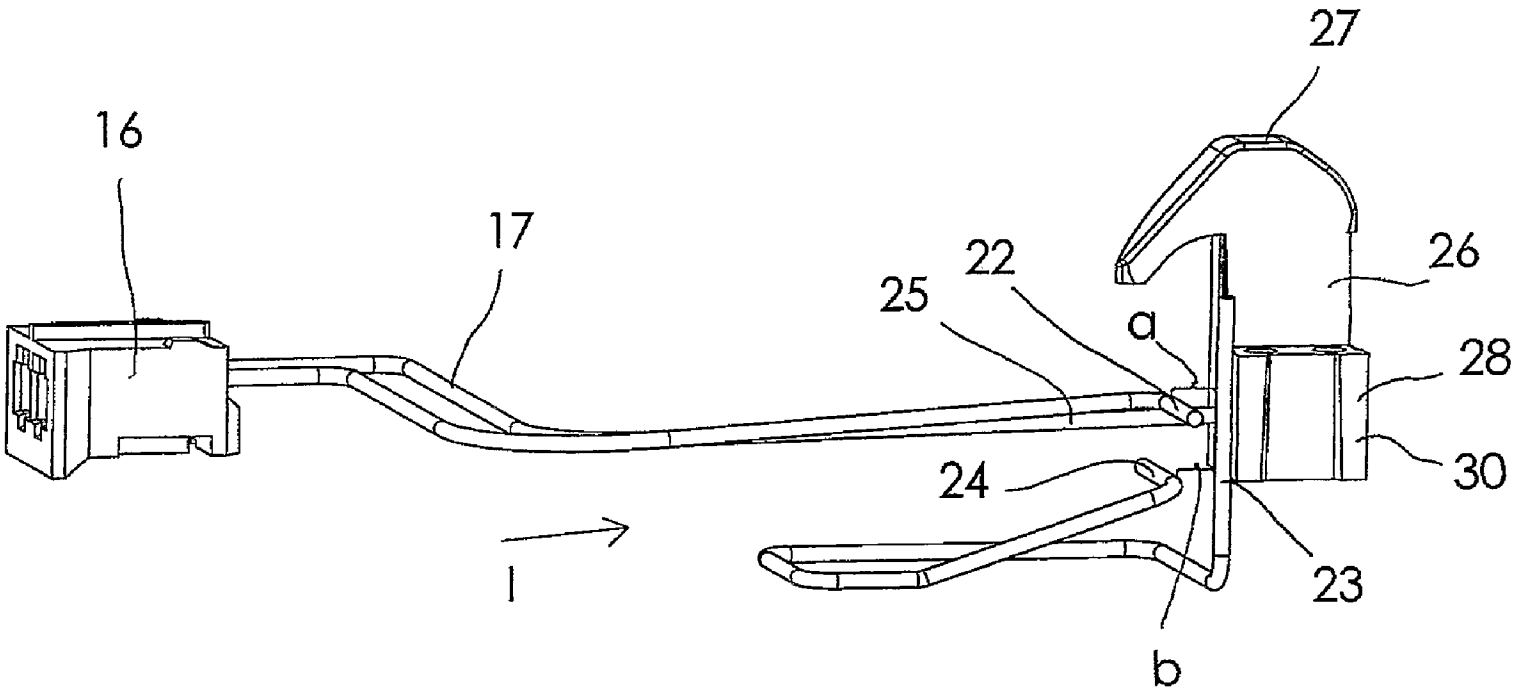
FIGS. 8-10 depict essential parts of the invention at three different stages.
Figure 9:
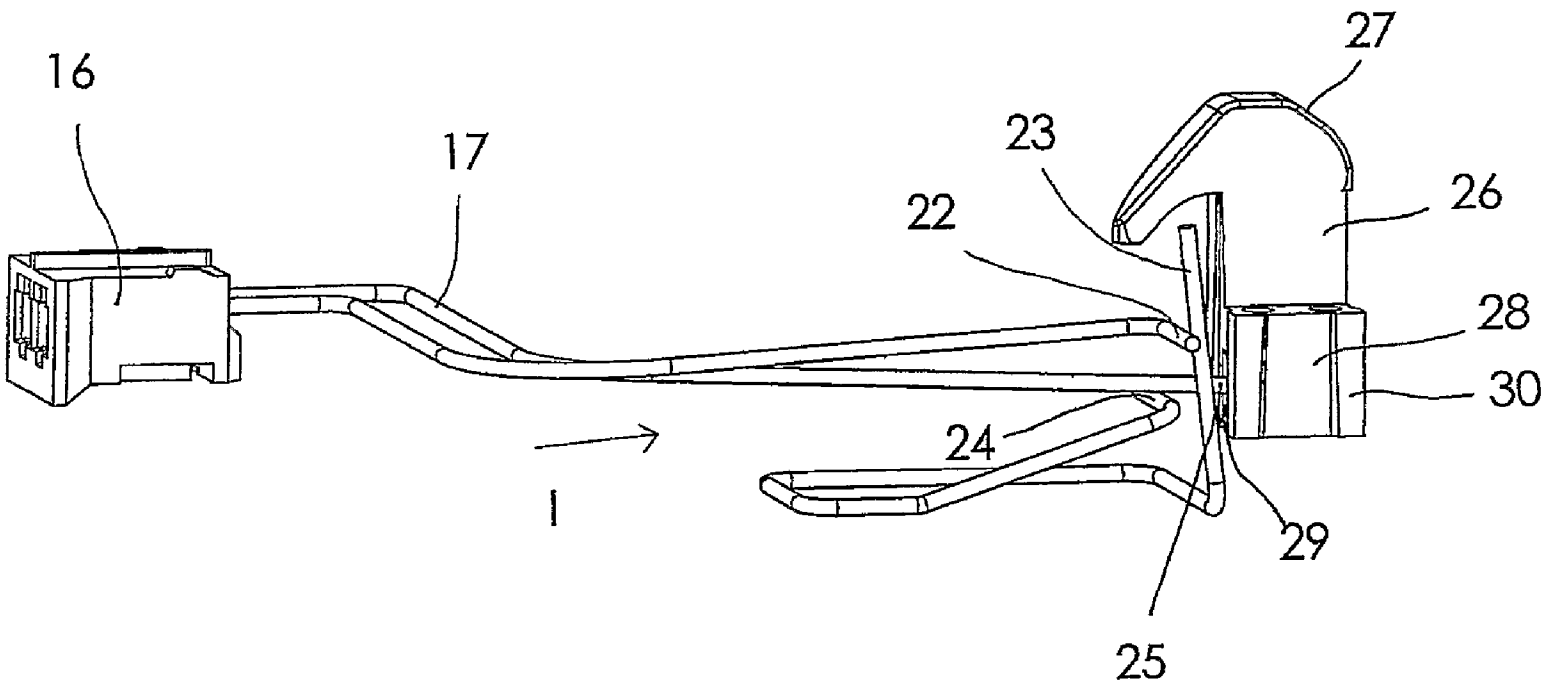
Figure 10:
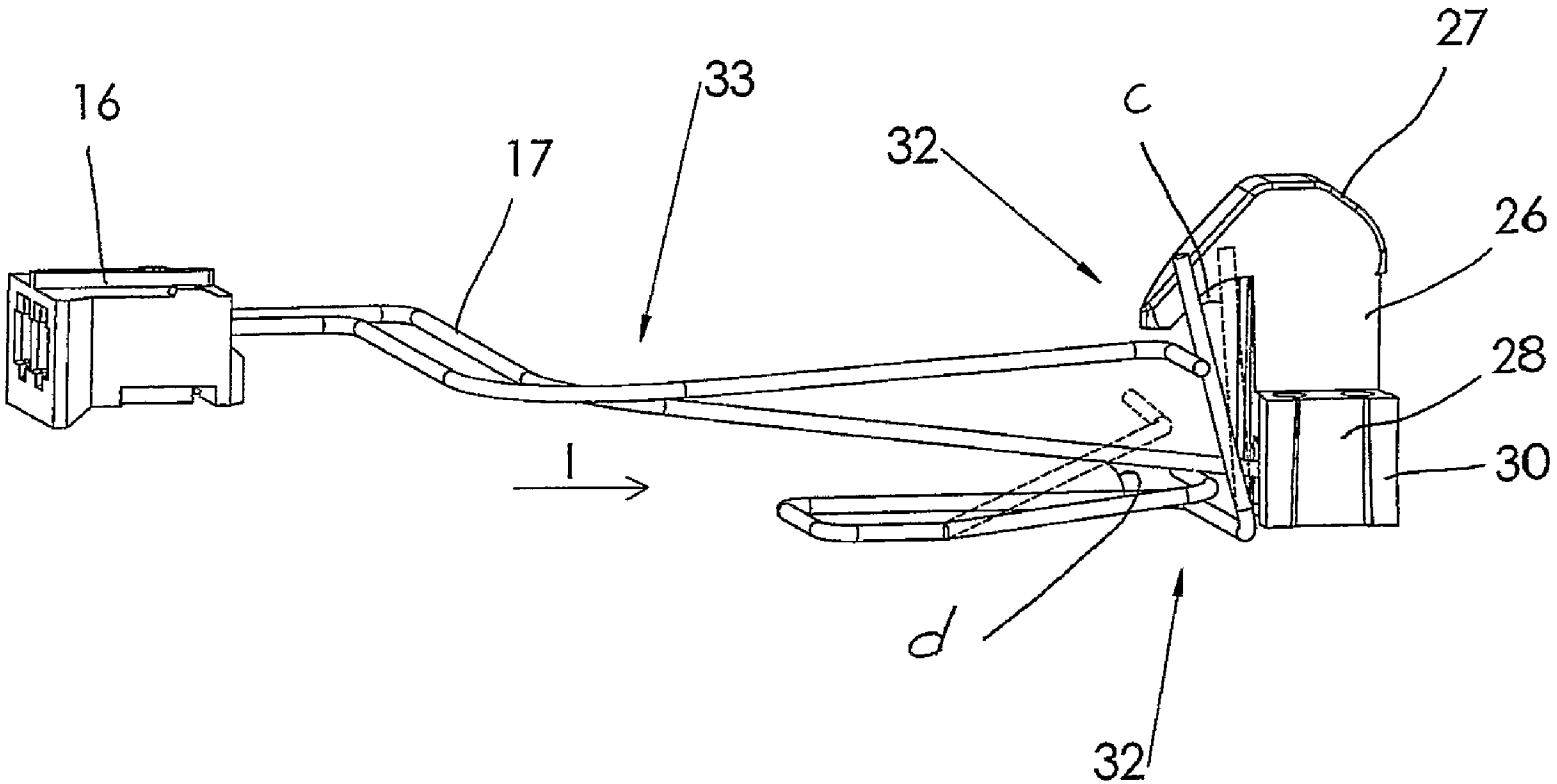

FIGS. 8-10 depict the connector 16, the line 17 and a link 26 which has at an upper first end an arcuate surface 27 and at a lower second end a block 28 which presents a groove 29 in which the second output line 25 is in a known manner connected. The block 28 has on its outside slide surfaces 30, of which only those surfaces facing towards the observer are visible in the drawings, although there are also such surfaces on the sides which are not visible in the drawings. As may be seen in FIG. 6, the block 28 is fitted slidably to a recess 31 in the lower portion 13 and the slide fit is so arranged that the block can move up and down in the recess 31 against a very slight resistance. FIG. 8 shows the lines in the first position and the input line 22 and output line 23 and input line 24 and line 25 being held at a distance a and b respectively apart so that no current I can pass through the line 17. In FIG. 9, the output lines 23 and 25 respectively have moved the distance a and b respectively to the second position and to contact with the input lines 22 and 24 respectively, a situation resulting in current I passing through the line 17, which current can be registered by the control means SO, not depicted in the drawing, thereby making it possible for the motor M, not depicted in the drawing, to be controlled in a known manner. In FIG. 10, the input line 22 and output line 23 and input line 24 and output line 25 have been brought together by being moved a further distance c and d respectively, which distances are marked between the broken-line depictions and the continuous-line depictions in FIG. 10, resulting in increased pressure between the lines 22 and 23 and between the lines 24 and 25 because the line is inherently resiliently flexible.

With reference to FIGS. 2-4 and 8-10, it is explained below how the lines 22, 23 and 24 25 respectively are moved from the first position to the second position so that each of them acts as a circuit-breaker arrangement 32 in the line 17 which serves as an indicating arrangement 33. As may be seen in the drawings, the lines in the first position are not connected together in an electrically conductive manner, so no current I can be supplied via the indicating arrangement 33. When the cassette 5 is fitted to the stapling head, the rails 11, 12 move on the slide surfaces 8, 9 and a means 34 made of an electrically non-conductive material on the cassette is brought into contact with the output line 23 which extends upwards through an aperture 35 in the cover 14. At the same time, the surface 27 of the link 26, which is likewise made of an electrically non-conductive material, impinges upon a staple blank strip 36 which is exposed through a window 37 provided in the cassette. When the cassette is brought to its fitted position, the link 26 is moved downwards by the staple blank strip, thereby causing the output line 25 and input line 24 to be brought together as depicted in FIGS. 9 and 10 and thereafter be moved while at the same time the means 34 brings together and thereafter moves the output line 23 and input line 22 in the manner depicted in FIGS. 9-10. When the lines are in this second position it is possible, as previously explained, for current I to pass through the line 17 and for the control means SO thereby to record the change which takes place in the power supply. When there is no staple blank strip in the cassette, the output line 25 moves away from the input line 24 because of the line being resiliently bent with the result that the contact between the lines 24 and 25 ceases and thereafter no further flow of current is possible. The same also applies in the case of the lines 22 and 23 if the cassette 5 is removed from the stapling head 2.

In the example described, the circuit-breaker arrangement in the first position was in a state in which no flow of current could take place. However, as may readily be appreciated by one skilled in the art, the arrangement in this state is in an energised position and is put into an unenergised position when the cassette is fitted. Accordingly, the lines must in this first position be in energised contact and be parted by the cassette as a result of the cassette and the link respectively impinging upon one of the input lines/output lines and in a known manner parting them. As may readily be appreciated by one skilled in the art, this is accomplished by the means 34 being adapted to impinging upon the input line 22 and the link 26 to be connected to the input line 24.

The invention claimed is:

1. A circuit-breaker arrangement in an indicating arrangement forming part of an electrically powered stapler, through which arrangement a current is supplied which is registered by a control means which is electrically connected to the arrangement and by which the stapler is controlled, which stapler comprises a stapling head and an anvil, said stapling head comprising a staple cassette fitted interchangeably in the stapling head and accommodating staple blanks, and the indicating arrangement, which arrangement comprises an electrical line itself comprising the circuit-breaker arrangement which is connected to the line by an input line and an output line and which is in a first position when no staple cassette is fitted in the stapling head and in a second position when a staple cassette is fitted in the stapling head, the lines being connected together for electrical conduction in one of the positions and being separated as regards electrical conduction in the other position, and the circuit-breaker arrangement being so positioned as to be moved by the staple cassette from the first to the second position when the staple cassette is fitted to the stapling head, resulting in the power supply via the indicating arrangement being changed, which change is registered by the control means, CHARACTERISED in that the circuit-breaker arrangement comprises input line and output line, of which at least the input line is dimensionally stable and resiliently flexible, in that the dimensionally stable and resilient line is impinged upon by a region of the staple cassette when the latter is fitted to the stapling head, resulting in the line being moved against its resilient resistance in such a way that the circuit-breaker arrangement switches from the first position to the second position, and in that the resilient resistance moves the circuit-breaker arrangement back to the first position when the cassette is removed from the stapling head.

2. A circuit-breaker arrangement according to claim 1, CHARACTERISED in that both the input line and the output line are dimensionally stable and resiliently flexible.

3. A circuit-breaker arrangement according to claim 2, CHARACTERISED in that the staple cassette moves both the input line and the output line to the second position against their resilient resistance when the cassette is fitted to the stapling head, and that both lines return to the first position when the cassette is removed from the stapling head.

4. A circuit-breaker arrangement according to claim 3, CHARACTERISED in that a link is provided between the staple cassette and the flexible resilient output line and is impinged upon by the staple cassette when the latter is fitted to the stapling head and moves the resilient line to the second position.

5. A circuit-breaker arrangement according to claim 2, CHARACTERISED in that a link is provided between the staple cassette and the flexible resilient output line and is impinged upon by the staple cassette when the latter is fitted to the stapling head and moves the resilient line to the second position.

6. A circuit-breaker arrangement according to claim 1, CHARACTERISED in that a link is provided between the staple cassette and the flexible resilient output line and is impinged upon by the staple cassette when the latter is fitted to the stapling head and moves the resilient line to the second position.

* * * * *